US005500999A

United States Patent [19]

Yagi et al.

[11] Patent Number: 5,500,999

[45] Date of Patent: Mar. 26, 1996

[54] TERMINAL CRIMPING DEVICE

[75] Inventors: Sakai Yagi; Hitoshi Sakai; Toshinori Yamamoto, all of Shizuoka, Japan

[73] Assignee: Yazaki Corporation, Tokyo, Japan

[21] Appl. No.: 384,598

[22] Filed: Feb. 3, 1995

Related U.S. Application Data

[63] Continuation of Ser. No. 96,002, Jul. 23, 1993, abandoned.

[30] Foreign Application Priority Data

Jul. 24, 1992 [JP] Japan ..... 4-217432

[51] Int. Cl.[6] ..... H01R 43/04

[52] U.S. Cl. ..... 29/753; 29/751; 72/409.12

[58] Field of Search ..... 29/751, 753, 863, 29/861, 564.1, 564.6, 749; 72/338, 409, 410

[56] References Cited

U.S. PATENT DOCUMENTS 4,598,570 7/1986 Baldyga ..... 29/753 X 4,812,138 3/1989 Kondo et al. .

4,821,383 4/1989 Grosklos et al. ..... 29/753 X 4,991,289 2/1991 French ..... 29/753 X

*Primary Examiner*—Carl E. Hall

*Attorney, Agent, or Firm*—Sughrue, Mion, Zinn, Macpeak & Seas

[57] ABSTRACT

A terminal crimping device comprising a pressing toothed upper die and a lower die for crimping an electrical terminal over an electrical wire, which is free from a difficulty that burrs are formed on the back of the electrical terminal in crimping the latter over the electrical wire. The terminal crimping device comprising a pressing toothed upper die having an axially symmetrical recess into which a lower die is inserted, the recess has linear guide walls, and the electrical terminal is crimped over the electrical wire in the space defined by the linear guide walls.

2 Claims, 3 Drawing Sheets

TERMINAL CRIMPING DEVICE

This is a continuation of application Ser. No. 08/096,002 filed Jul. 23, 1993, now abandoned.

BACKGROUND OF THE INVENTION

1. Field of the Invention

This invention relates to terminal crimping devices and more particularly to a terminal crimping device which is used to crimp the clasping lugs of an electrical terminal over an electrical wire to fixedly connect the terminal to the wire, for instance, no matter what the diameter of the wire is.

2. Prior Art

An electrical terminal is well known in the art, which is connected to an electrical wire by crimping it. The electrical terminal has crimping portions at its rear end portion which are used for fixedly holding an electrical wire. With an electrical wire placed on the rear end portion of the electrical terminal, the crimping portions are bent inwardly in such a manner as to fixedly embrace the electrical wire (cf. Examined Japanese Patent Application Publication No. Sho. 55-37840).

In order to fixedly connect an electrical terminal to an electrical wire, a terminal crimping device as shown in FIG. 5 is used as follows: The device comprises: an upper die, namely, a pressing toothed upper die 1; and a lower die 2. An electrical terminal 3 is set on the lower die 2, and an electrical wire 4 is placed between the clasping lugs 3*a* and 3*a* of an electrical terminal 3. Under this condition, the toothed upper die 1 is pushed against the lower die 2. As a result, the clasping lugs 3*a* and 3*b* are bent inwardly in such a manner as to embrace and bite the electrical wire 4.

The pressing toothed upper die 1 has an axially symmetrical recess 5 which consists of right and left guide walls 1*a* and 1*a* which are sloped and opened towards the lower die 2, and right and left pressing curved walls 1*b* and 1*b* which merge with the right and left guide walls 1*a* and 1*a*, respectively. The pressing toothed upper die 1 is slid downwardly as indicated by the arrow P until the lower die 2 comes in the recess 5. When the pressing toothed upper die 1 and the lower die 2, which have been engaged with each other in the above-described manner, are slid relative to each other, the clasping lugs 3*a* and 3*a* substantially U-shaped in section are bent inwardly while sliding on the sloped guide walls 1*a* and 1*a*. Thereafter, the clasping lugs 3*a* and 3*a* are sufficiently crimped by the pressing walls 1*b* and 1*b* while being guided by the latter.

FIG. 6 shows an electrical terminal which has been crimped over an electrical wire 4 by the above-described conventional terminal crimping device. In the case of FIG. 6, the electrical wire 4 connected to the electrical terminal is small in diameter (size).

In the case where an electrical wire to be connected to the electrical terminal with the device is relatively small in diameter, as shown in FIG. 6 a crimp height Y is provided between the toothed upper die 1 and the lower die 2 when those dies 1 and 2 are engaged with each other to crimp the electrical terminal over the electrical wire.

The above-described conventional terminal crimping device is disadvantageous in the following points:

In the case where an electrical wire to be connected is relatively large in diameter, as shown in FIG. 7 the crimp height Y is larger than in the above-described case where the electrical wire is relatively small in diameter. When the crimp height Y is large, then there is formed a gap X between the lower die 2 and each of the sloped guide walls 1*a* because the recess 5 formed by the sloped guide walls 1*a* and 1*a* is gradually wider towards the outer end face of the toothed upper die 1. Because of the gaps X on both sides of the lower die 2, burrs 6 are formed on the back of the electrical terminal 3.

The burrs 6 thus formed make it impossible to measure the crimp height of the terminal thus connected. Therefore, it is impossible to measure the degree of tightness of the terminal, and accordingly it is also impossible to determine whether or not the electrical wire has been sufficiently connected to the electrical terminal. Moreover, the burrs are liable to crack the terminal. In addition, in inserting the electrical terminal thus connected into the housing, the burrs may damage the latter or make it impossible to insert it into it.

SUMMARY OF THE INVENTION

In view of the foregoing, an object of this invention is to provide a terminal crimping device which can satisfactorily crimp the crimping portion or portions of an electrical terminal over an electrical wire no matter what the size of the electrical terminal or an electrical wire to be connected to the latter is.

The foregoing object of the invention has been achieved by the provision of a terminal crimping device comprising: a pressing toothed upper die having a recess; and a lower die which is engaged with the recess of the pressing toothed upper die to crimp an electrical terminal over an electrical wire thereby to connect the electrical terminal to the electrical wire, wherein the recess has linear guide walls adapted to guide the lower die, and the electrical terminal is crimped over the electrical wire in a space defined by the linear guide walls.

The linear guide walls are parallel with each other, so that the lower die is slid, relative to the pressing toothed upper die, in the space defined by the linear guide wall. Hence, in the terminal crimping device of the invention, no matter what the diameter of the electrical wire is; i.e., no matter what the crimp height Y is, no gap is formed between the pressing toothed upper die and the lower die, and therefore the electrical terminal is satisfactorily connected to the electrical wire by crimping.

DETAILED DESCRIPTION OF THE PREFERRED EMBODIMENTS

A terminal crimping device according to this invention will be described with reference to the accompanying drawings.

Figure 1:
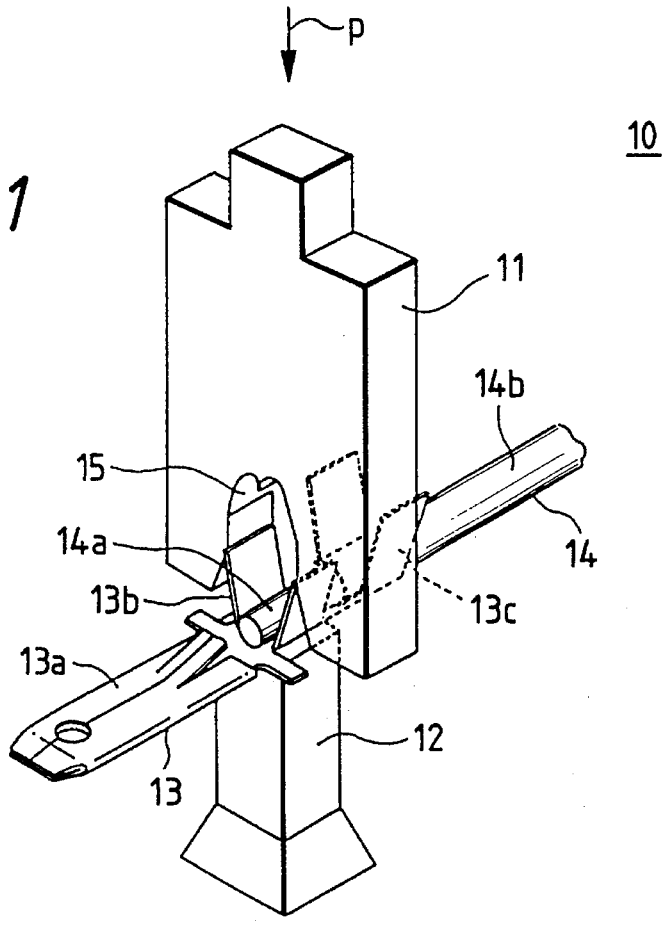
FIG. 1 is a perspective view for a description of the operation of a terminal crimping device comprising upper and lower metal dies, which constitutes one embodiment of this invention.

FIG. 1 is an explanatory diagram for a description of the operation of upper and lower dies in the terminal crimping device of the invention.

As shown in FIG. 1, the terminal crimping device 10 of the invention comprises: a pressing toothed upper die 11; and a lower die 12. The pressing toothed upper die 11 has a recess 15, into which the lower die 2 is brought when the toothed upper die 11 is slid in the direction of the arrow P. The lower die 12 is fixedly positioned, and adapted to receive an electrical terminal 13 on it.

The electrical terminal 13 is a conventional one. That is, the electrical terminal 13 comprises: a contact portion 13*a*; first clasping lugs 13*b* and 13*b* which are extended substantially U-shaped from both side of the rear half of the contact portion 13*a*; and second clasping lugs 13*c* and 13*c* which are also extended from both side of the rear half of the contact portion 13*a*. The first clasping lugs 13*b* are to fixedly hold the core conductors 14*a* of the electrical wire 14, and the second clasping lugs 13*c* are to fixedly hold the insulating cover 14*b* of the electrical wire 14.

Figure 2:
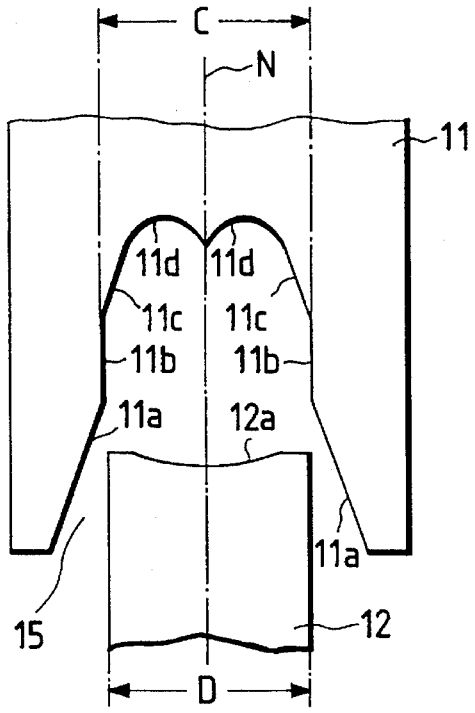
FIG. 2 is a side view showing essential components of the terminal crimping device according to the invention.

As shown in FIG. 2, first sloped guide walls 11*a* and 11*a*, linear guide walls 11*b* and 11*b* merging with the walls 11*a* and 11*a* respectively, second sloped guide walls 11*c* and 11*c* merging with the walls 11*b* and 11*b* respectively, and curved pressing walls 11*d* and 11*d* merging with the walls 11*c* and 11*c* respectively are arranged symmetrical with respect to a central phantom line N, thus defining the recess 15 of the pressing toothed upper die 11.

The sloped guide walls 11*a* and 11*a* are so designed that they are simultaneously brought into contact with the upper edges of the (for instance) first clasping lugs 13*b* and 13*b* of the electrical terminal 13 laid on the lower die 12, thereby to correct the posture of the electrical terminal. Since the sloped guide walls are gradually wider towards the lower end face of the pressing toothed upper die, the electrical terminal 13 connected to the electrical wire can be removed from the recess 15 with ease.

The linear guide walls 11*b*, one of the specific features of the invention, are parallel with each other, and the distance C between them is substantially equal to the width D of the lower die 12. With the lower die 12 set in the space defined by the linear guide walls 11*b*, the two dies 11 and 12 are slid relative to each other, to form a variable space in the recess 15. The variable space thus formed makes it possible for the device to handle electrical wires different in diameter.

The second sloped guide walls 11*c* and 11*c*, merging with the curved pressing walls 11*d* and 11*d*, are inclined convergent, thus being substantially coincident with tangent lines to the curved pressing walls 11*d* and 11*d* which are semicircular.

The upper end face 12*a* of the lower die 12 is a downwardly curved surface which is substantially equal in curvature to the back of each of the first and second clasping lugs 13*b* and 13*c*. Therefore, those clasping lugs 13*b* and 13*c* can be stably placed on the lower die 12.

The operation of the terminal crimping device 10 will be described with reference to the case where the electrical terminal 13 is fixedly connected to an electrical wire 14 large in diameter by crimping.

First, a preparatory operation is carried out. That is, as shown in FIG. 1, the clasping lugs 13*b* and 13*b* of the electrical terminal are placed on the lower die 12, and the core conductors 14*a* of the electrical wire 14 are set between the clasping lugs 13*b* and 13*b* thus placed. Under this condition, the pressing toothed upper die 11 is slid towards the lower die 12, as a result of which the upper edges of the right and left clasping lugs 13*b* and 13*b* are brought into contact with the first sloped guide walls 11*a* and 11*a* and guided by the latter. In this operation, since the upper edges of the right and left clasping lugs 13*b* and 13*b* are abutted against the first sloped guide walls 11*a* and 11*a* as was described above, the electrical terminal 13 is positioned in place even if it has been more or less shifted in position when placed on the lower die 12.

Figure 3:
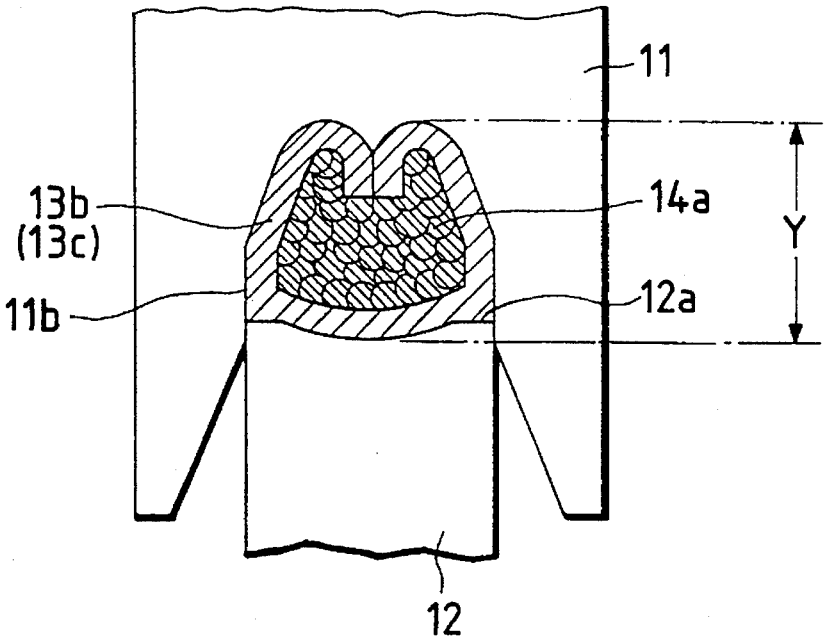
FIG. 3 is a diagram showing an electrical terminal crimped over an electrical wire relatively large in diameter with the terminal crimping device of the invention.

As the pressing toothed upper die 11 is further slid downwardly, the right and left clasping lugs 13*b* and 13*b* are guided with their upper edges being slid on the linear guide walls 11*b* and 11*b*, and then introduced to the second sloped guide walls 11*c* and 11*c*. Being guided by the second sloped guide walls 11*c* and 11*c*, the clasping lugs 13*b* and 13*b* are gradually bent inwardly by the inclination of the guide walls 11*c* and the sliding force, to embrace the conductors 14*a*, and finally crimped over the conductors by the curved pressing walls 11*d*. That is, the upper edges of the clasping lugs 13*b* and 13*b* are pressed to bite the conductors 14*a* of the electrical wire 14. Under this condition, the upper end face 12*a* of the lower die, which forms the variable space when the clasping lugs are pressed, is in the space defined by the linear guide walls 11*b* and 11*b* as shown in FIG. 3. This eliminates the difficulty accompanying the conventional terminal crimping device that the gaps are formed between the pressing toothed upper die and the lower die. After the clasping lugs have been pressed against the electrical wire in the above-described manner, the pressing toothed upper die 11 is slid upwardly, away from the lower die 12, whereby the electrical terminal 13 connected to the electrical wire 14 is allowed to drop from the recess 15 of the pressing toothed upper die 11.

The above description of the operation of the terminal crimping device may be applied, substantially as it is, to the case where the electrical terminal 13 and the electrical wire 14 are moved axially, and then the insulating cover 14*b* of the electrical wire 14 are fixedly held by the second clasping lugs 13*c* and 13*c*. In this case, two terminal crimping devices may be provided as one unit so that they simultaneously crimp the first and second clasping lugs 13*b* and 13*c*, respectively.

Figure 4:
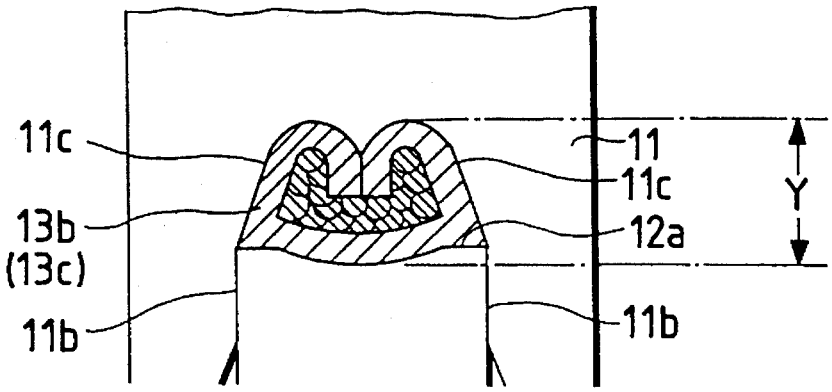
FIG. 4 is a diagram showing an electrical terminal crimped over an electrical wire relatively small in diameter with the terminal crimping device of the invention.
Figure 5:
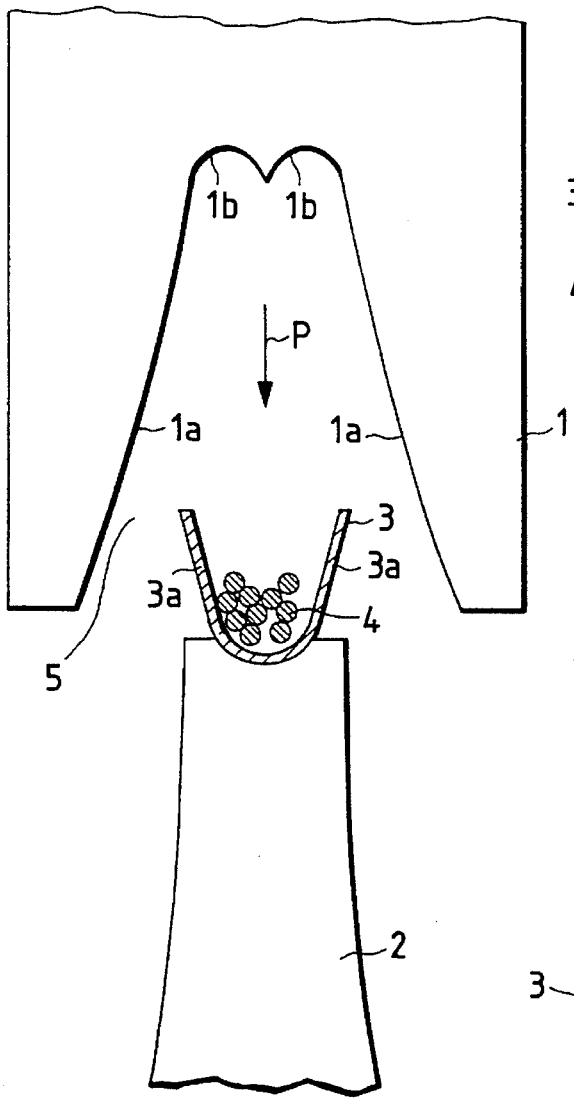
FIG. 5 is a diagram showing an operation of crimping an electrical terminal over an electrical wire with a conventional terminal crimping device which crimps.
Figure 6:
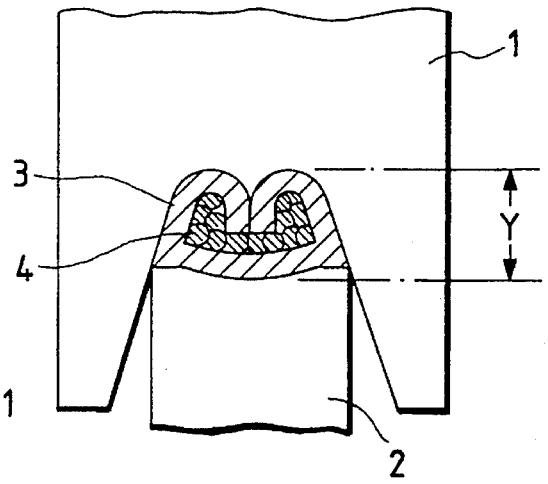
FIG. 6 is a diagram showing an electrical terminal crimped over an electrical wire relatively small in diameter with the conventional terminal crimping device.
Figure 7:
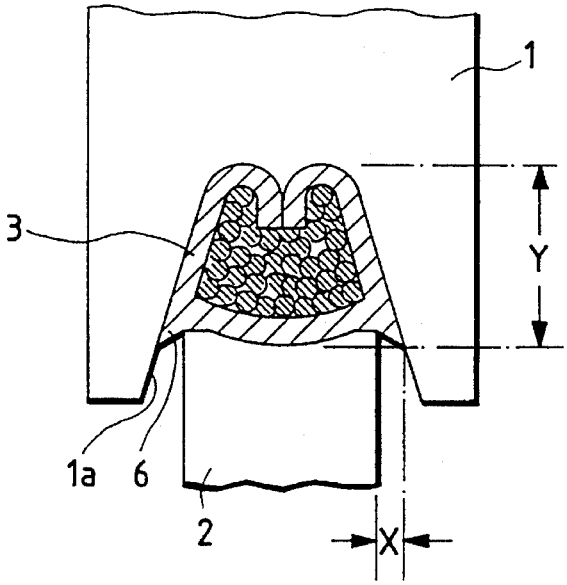
FIG. 7 is a diagram showing an electrical terminal crimped over an electrical wire relatively large in diameter with the conventional terminal crimping device.

FIG. 4 is a diagram showing the electrical terminal which is connected to an electrical wire relatively small in diameter with the terminal crimping device of the invention. The pressing toothed upper died 11 is slid downwardly further than in the case where the electrical terminal is connected to an electrical wire relatively large in diameter, and the upper end face 12*a* of the lower die 12 is located in the space defined by the linear guide walls 11*b* and 11*b* and near the second sloped guide walls 11*c*. Thus, even in the case where the electrical terminal is connected to an electrical wire relatively small in diameter, the first and second clasping lugs 13*b* and 13*c* are crimped in the same manner as in the case where the electrical terminal is connected to an electrical wire relatively large in diameter.

In the terminal crimping device 10 of the invention, the upper end face of the lower die 12 is held in the space defined by the linear guide walls 1*b* of the pressing toothed upper die even in the case where the crimp height Y between the pressing toothed upper die and the lower die is changed because the electrical wire is changed in size or the clasping lugs are changed in size. Hence, the terminal crimping device 10 of the invention is free from the difficulties accompanying the conventional terminal crimping device that the gaps are formed between the pressing toothed upper die and the lower die, and burrs are formed on the back of the electrical terminal.

As was described above, in the terminal crimping device according to the invention, the pressing toothed upper die, into which the lower die is inserted, has the linear guide walls. The pressing toothed upper die and the lower die are pushed towards each other in the space defined by the linear guide walls to fixedly connect the electrical wire to the electrical terminal by crimping the latter. Therefore, the terminal crimping device is free from the difficulty accompanying the conventional terminal crimping device that burrs are formed on the back of the electrical terminal. Furthermore, the above-described structure of the terminal crimping device makes it possible to fixedly connect electrical wires different in diameter to electrical terminals different in size by crimping the latter. In addition, with the terminal crimping device of the invention, the electrical terminal is prevented from being cracked when crimped; that is, it can be electrically connected to the electrical wire with high reliability at all times.

What is claimed is:

1. A terminal crimping device comprising:

a pressing toothed upper die having a recess, said recess being defined by opposing side walls each including a vertically extending linear guide wall of predetermined length, said linear guide walls being spaced by a constant predetermined distance over said predetermined length and defining a space therebetween; and a lower die engaged with said recess of said pressing toothed upper die to crimp an electrical terminal over an electrical wire so as to connect said electrical terminal to said electrical wire, the width of said lower die being substantially equal to said predetermined distance, wherein said electrical terminal is crimped over said electrical wire while said lower die is in said space defined by said vertically extending linear guide walls, and wherein each of said side walls further includes a pair of inclined guide walls which are separated by said vertically extending linear guide walls.

2. The terminal crimping device as claimed in claim 1, wherein said inclined guide walls are linear.

* * * * *